United States Patent [19]

Bodziak et al.

[11] Patent Number: 5,011,186

[45] Date of Patent: Apr. 30, 1991

[54] HEXAGONAL PAD

[75] Inventors: Douglas P. Bodziak; Ray A. Hunder; Steven P. Roth; Steven L. Grovender; Robert P. Molenda, all of St. Paul, Minn.

[73] Assignee: Minnesota Mining & Manufacturing Company, St. Paul, Minn.

[21] Appl. No.: 479,841

[22] Filed: Feb. 14, 1990

[51] Int. Cl.[5] ..... B42D 1/00

[52] U.S. Cl. ..... 281/12; 281/2; 281/45; 281/51; 283/81

[58] Field of Search ..... 281/45, 51, 2, 12; DIG. 19/1, 2, 26; 283/81

[56] References Cited

U.S. PATENT DOCUMENTS 4,105,224 8/1978 Rodebaugh et al. ..... 281/45

4,884,826 12/1989 Slagsvol ..... 281/51

OTHER PUBLICATIONS

Various shapes of memo pads from "Current", 8-1985.

Various shapes of memo pads from "Current", 1-1986.

United States Statutory Invention Registration #H377, Greig, 12-1987, class 281 subclass 2.

*Primary Examiner*—Mark Rosenbaum

*Assistant Examiner*—Hwei-Siu Payer

*Attorney, Agent, or Firm*—Gary L. Griswold; Walter N. Kirn; William L. Huebsch

[57] ABSTRACT

A pad of regular hexagonal flexible sheets each having a front surface adapted to be written on, and a coating of repositionable pressure sensitive adhesive over a portion of its rear surface releasably adhering the sheet to an underlying sheet in the pad. Information can be written on the front surfaces of the sheets, and the individual written on sheets can be adhered to a planar surface in side by side relationship with edge portions of up to six adjacent sheets in contact to represent relationships between the information on the sheets.

5 Claims, 2 Drawing Sheets

HEXAGONAL PAD

TECHNICAL FIELD

The present invention relates to pads of sheets used to record and display information during meetings intended to develop ideas and/or solve problems, and to the way such sheets are displayed during such meetings.

BACKGROUND ART

Various methods have been described for conducting meetings intended to generate ideas and/or solve problems (e.g., meetings intended for brainstorming, strategic planning, developing mission statements, identifying critical issues, problem solving, situation analysis, developing flow diagrams, etc.) in which a manager or facilitator has participants in the meeting write information (e.g., ideas, problems, issues, advantages or disadvantages, etc.) on sheets of paper and then attaches the sheets to a display surface (e.g., on a wall or chart) in different arrays or groupings which may be changed or reorganized as the meeting progresses to help analyze, build relationships between, or collect the information in a logical manner. Sheets from a pad of "POST-IT" brand notes commercially available from Minnesota Mining and Manufacturing Company, St. Paul, Minn., (which sheets are flexible, rectangular, have a front surface adapted to be written on, and a coating of repositionable pressure sensitive adhesive over a portion of said rear surface) have been used and found useful in such methods because the repositionable adhesive allows the sheets to be positioned and repositioned as needed in the arrays and groupings during the meeting. Examples of such use include the "SCOPE" process for problem solving demonstrated by Gerald N. Hatton, President of Hatton & Co., The Bank Group, 1726 Cole Blvd. Suite 325, Golden, Colo., 80401, involving the use of various sizes of "POST-IT" brand notes as "Memory Anchors". Also, the book entitled "Writing to Please Your Boss", by Elizabeth Cohn and Susan Kleimann, PC Press, 1989, 51 Monroe Street, Suite 1101, Rockville, Md., 20850, describes a process for brainstorming ideas and arranging them using "POST-IT" brand notes.

DISCLOSURE OF INVENTION

The present invention provides a pad of sheets that can provide a significant advantage in illustrating relationships between pieces of information written on the sheets when used in a method of the type described above.

According to the present invention there is provided a pad comprising a plurality of flexible sheets, each sheet having a regular hexagonal peripheral edge defined by six straight edge portions, a front surface adapted to be written on, and a coating of repositionable pressure sensitive adhesive over a portion of its rear surface releasably adhering the sheet to an underlying sheet in the pad with the straight edge portions of the peripheral edges of the sheets in alignment. The rear surfaces of the sheets have portions free of adhesive to afford removal of the sheets from the pad by peeling the uppermost sheet from underlying sheets in the pad. Information can be written on the front surfaces of the sheets, and the written on and removed sheets can be adhered to a planar surface in side by side relationship with straight edge portions of up to six adjacent sheets in contact to represent relationships between the information on the sheets.

Preferably the coating of repositionable adhesive on each sheet extends across the rear surface of the sheet over the center of the sheet and between opposite straight edge portions, and the rear surface has at least one portion free of adhesive adjacent the intersections of the two straight edge portions on one side of the opposite straight edge portions between which the coating of adhesive extends.

Additionally, if desired the front surface of the pad can have indicia defining areas of the sheet on which information is to be provided, or designating the type of information to be provided, or providing a desired design, such as a generally triangular portion of the front surface adjacent the intersection of two straight edge portions that is visually distinctive with respect to the other portion of the front surface to form a pointer on the front surface.

Also, preferably the sheets in the pad have a dimension between opposite straight edge portions of at least 10 centimeters (4 inches) to provide adequate area on which information can be written in large print, and the sheets could be much larger (e.g., 25 centimeters or 10 inches between opposite straight edge portions, or larger) should that be desirable to afford readability of information at large gatherings.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
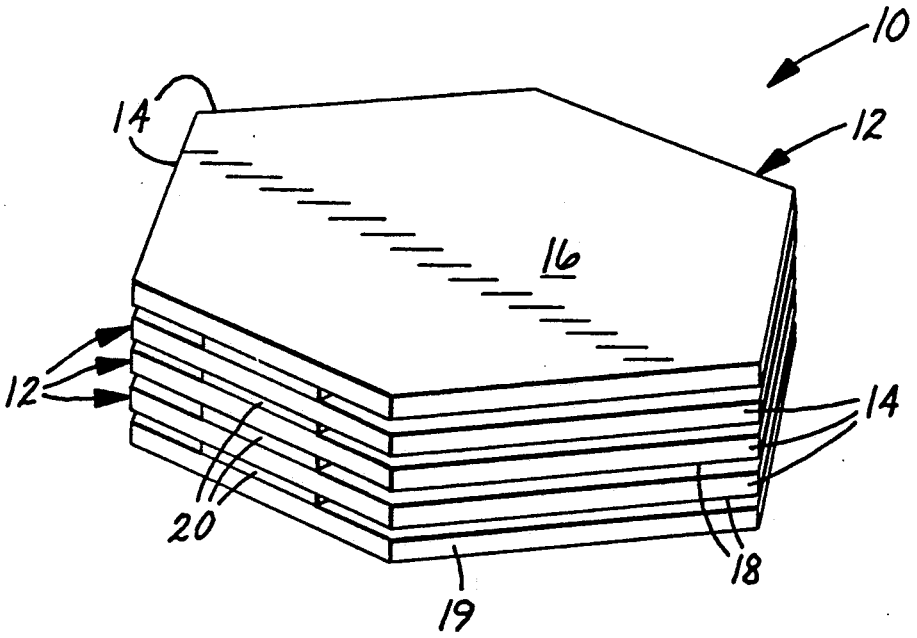
FIG. 1 is a perspective view of a pad according to the present invention.
Figure 2:
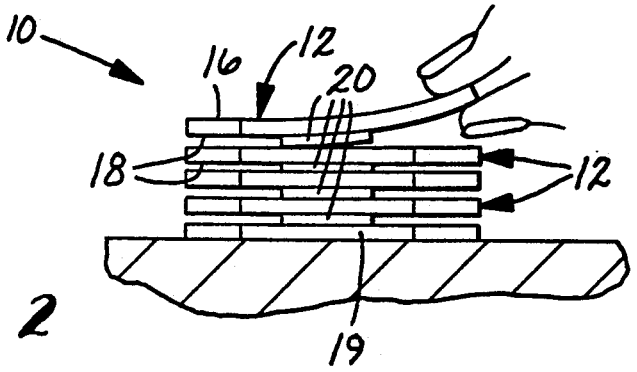
FIG. 2 is a side view illustrating a sheet being removed from the pad of FIG. 1.

Referring now to the drawing, there is shown in FIGS. 1 and 2 a pad according to the present invention generally designated by the reference numeral 10.

Generally the pad 10 comprises a plurality of flexible sheets 12 (e.g., of paper, light cardboard, or polymeric material) each having a regular hexagonal peripheral edge defined by six straight edge portions 14, a front surface 16 adapted to be written on, a rear surface 18, and a coating 20 of repositionable pressure sensitive adhesive over a portion of its rear surface 18 releasably adhering each sheet 12 to an underlying sheet 12 in the pad 10 with the straight edge portions 14 of the peripheral edges of the sheets 12 in alignment. The lowermost sheet 12 in the pad 10 is adhered to a backing sheet 19 which has the same size and shape as the sheets 12, and may, as is conventional, have product identification information printed on its side opposite the sheets 12.

Figure 3:
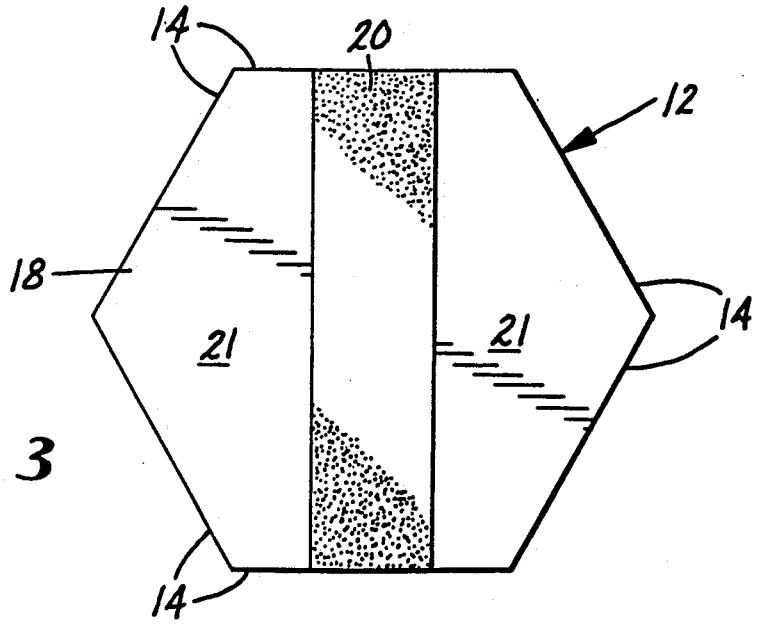
FIG. 3 is a rear view of one of the sheets in the pad of FIG. 1.

As is best seen in FIG. 3, the coating 20 of repositionable adhesive on each sheet 12 is rectangular and extends across the rear surface 18 of the sheet 12 over the center of the sheet and between opposite straight edge portions 14, and the rear surface 18 of each sheet has two portions 21 free of adhesive adjacent the intersections of the two straight edge portions 14 on both sides of the opposite straight edge portions 14 between which the coating 20 of adhesive extends to afford removal of the sheets 12 from the pad 10 by peeling the sheets 12 from underlying sheets 12 in the pad 10, as is illustrated in FIG. 2 for the uppermost sheet 12, by grasping the uppermost sheet 12 in the pad 10 adjacent one of those intersections.

Figure 4:
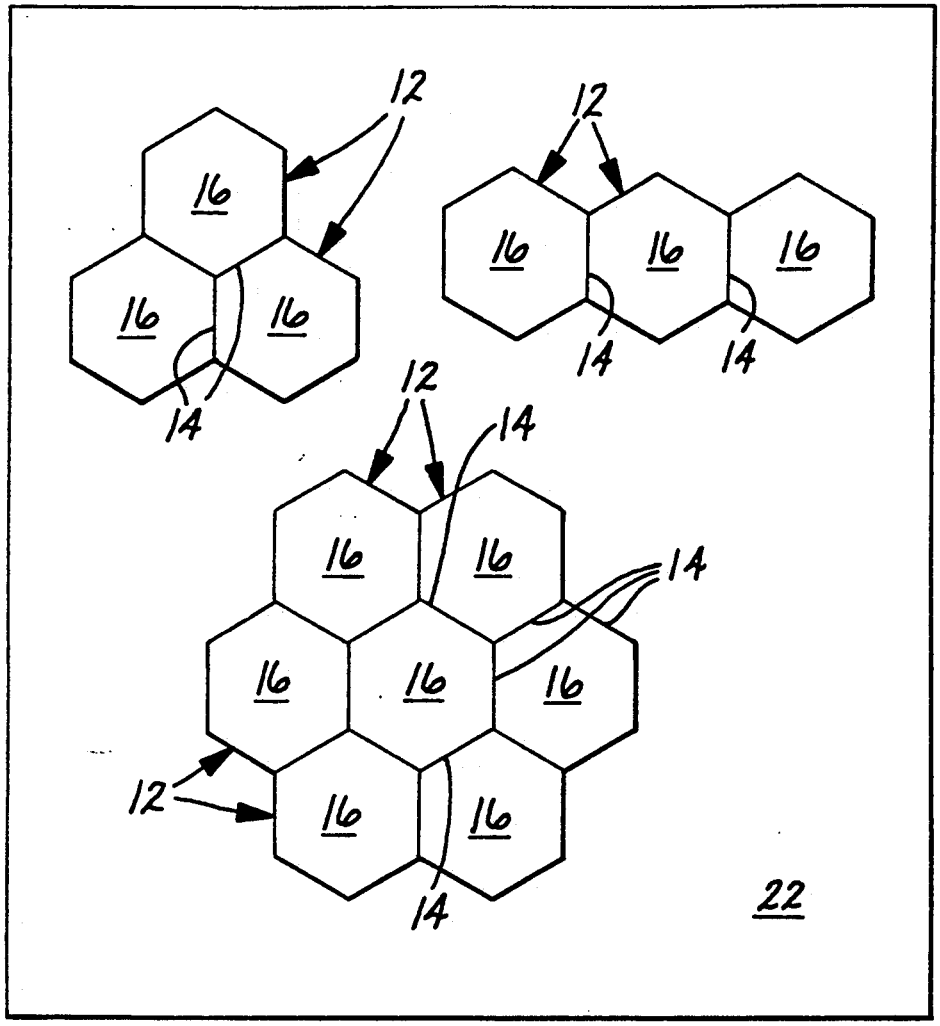
FIG. 4 illustrates some arrays that can be made using sheets from the pad of FIG. 1.

The sheets 12 from the pad 10 are particularly useful in the methods described above for conducting meetings intended to generate ideas and/or solve problems (e.g., meetings intended for brainstorming, strategic planning, developing mission statements, identifying critical issues, problem solving, situation analysis, developing flow diagrams, etc.) in which a manager or facilitator has participants in the meeting write information (e.g., ideas, problems, issues, advantages or disadvantages, etc.) on the sheets 12 either before or after they are removed from the pad 10 and then attaches the sheets 12 to a display surface 22 (e.g., the surface of a wall or chart) in different arrays or groupings such as those illustrated in FIG. 4 which may be changed or reorganized as the meeting progresses to help analyze, build relationships between, or collect the information in a logical manner. In the arrays or groupings the sheets 12 are displayed in side by side relationship with straight edge portions 14 of adjacent sheets 12 in contact to represent relationships between the information on the sheets 12, and as is illustrated in the bottom grouping in FIG. 4, up to six different sheets 12 may be associated around the periphery of each sheet 12 in each grouping, which provides opportunities to relate the information on six different sheets 12 thereto.

Figure 5:
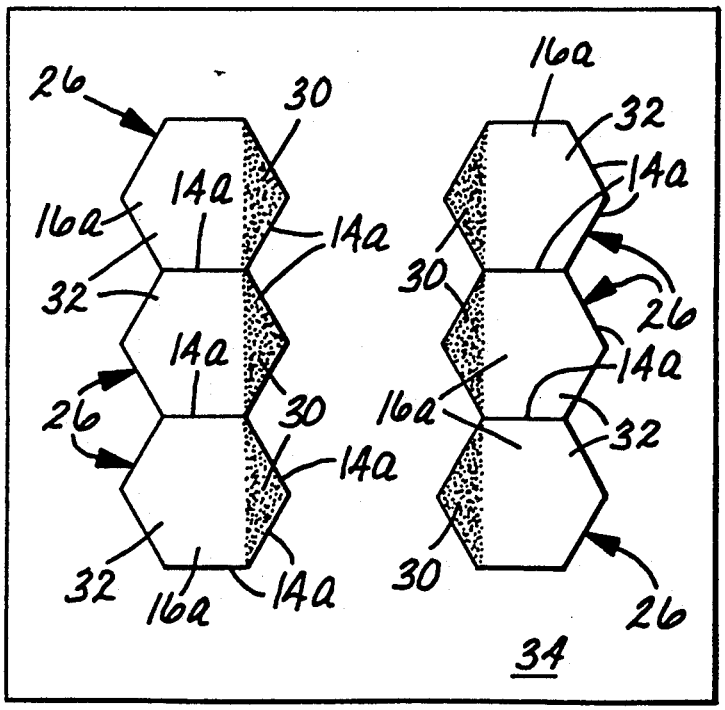
FIG. 5 illustrates some arrays that can be made using sheets that are essentially the same as the sheets from the pad of FIG. 1 except that they have a visually distinctive portions of their front surfaces in the shape of arrows or pointers.

The sheets 12 may be of any color or combination of colors, and pads 10 of sheets 12 of different colors may be advantageously used together to provide contrast between different types of information. Also, although not illustrated in FIGS. 1 through 4, the front surfaces of the sheets 12 may be pre-printed with various messages, indications of where information should be printed on the sheets 12, or designs. As an example, FIG. 5 illustrates sheets 26 having the same structure as the sheets 12 (with like parts having like reference numerals except for the addition of the suffix "a") except that triangular portions 30 of the front surfaces **16*a* of the sheets 26 adjacent the intersection of two straight edge portions 14*a* thereof are printed (e.g., with red or green ink) to be visually distinctive with respect to other portions 32 of the front surfaces 16*a* to form pointers on the front surfaces 16*a*. Thus, as illustrated in FIG. 5, such sheets 26 can be disposed on a display surface 34 in groups set in opposition to each other with the triangular portions 30 or pointers on opposite sheets 26** pointed toward each other as may be useful to display information on opposing sides of an argument or from which a user could reach opposite conclusions.

The present invention has now been described with reference to one embodiment and one modification thereof. It will be apparent to those skilled in the art that many changes can be made in the embodiment described without departing from the scope of the present invention. For example, the coating of adhesive on each sheet in the pad could extend over a larger portion of its rear surface (e.g., over all but a portion of the rear surface adjacent just one intersection between two edge surfaces) if that were desired to adhere the sheets to certain types of display surfaces or to insure that the sheet would lay flat along the display surface. Thus the scope of the present invention should not be limited to the structure described in this application, but only by structures described by the language of the claims and the equivalents of those structures.

We claim:

1. A pad comprising a plurality of flexible sheets each having a regular hexagonal peripheral edge defined by six straight edge portions, a front surface adapted to be written on, a rear surface, and a coating of repositionable pressure sensitive adhesive over a portion of said rear surface extending across the rear surface of said sheet between opposite straight edge portions releasably adhering said sheet to an underlying sheet in said pad with the straight edge portions of the peripheral edges of said sheets in alignment, said rear surface of each sheet having a portion free of adhesive adjacent the intersection of two straight edge portions on one side of said opposite straight edge portions to afford removal of said sheets from said pad by peeling the uppermost sheet from underlying sheets in the pad, whereby a user may write information on the front surfaces of a plurality of the sheets, remove said plurality of the sheets, and adhere the removed sheets to a planar surface in side by side relationship with straight edge portions of up to six adjacent sheets in contact to represent relationships between the information on the sheets.

2. A pad according to claim 1 wherein said front surface of said pad has a generally triangular portion adjacent the intersection of two straight edge portions that is visually distinctive with respect to the other portion of the front surface to form a pointer on said front surface at said intersection.

3. A pad according to claim 1 wherein said sheets have a dimension between opposite straight edge portions of at least 10 centimeters (4 inches).

4. A pad comprising a plurality of flexible sheets each having a regular hexagonal peripheral edge defined by six straight edge portions, a front surface adapted to be written on, a rear surface, and a coating of repositionable pressure sensitive adhesive over a portion of said rear surface over the center of the sheet and between opposite straight edge portions releasably adhering said sheet to an underlying sheet in said pad with the straight edge portions of the peripheral edges of said sheets in alignment, and said rear surface of each sheet having two portions free of adhesive adjacent the intersections of the two straight edge portions on both sides of said opposite straight edge portions to afford removal of said sheets from said pad by peeling the uppermost sheet from underlying sheets in the pad, whereby a user may write information on the front surfaces of a plurality of the sheets, remove said plurality of the sheets, and adhere the removed sheets to a planar surface in side by side relationship with straight edge portions of up to six adjacent sheets in contact to represent relationships between the information on the sheets.

5. A pad according to claim 4 wherein said front surface of said pad has a generally triangular portion adjacent the intersection of two straight edge portions that is visually distinctive with respect to the other portion of the front surface to form a pointer on said front surface at said intersection.

* * * * *